US010203144B2

(12) United States Patent
Kilinc et al.

(10) Patent No.: US 10,203,144 B2
(45) Date of Patent: Feb. 12, 2019

(54) REFRIGERATION DEVICE COMPRISING A REFRIGERANT CIRCUIT WITH A MULTI SUCTION LINE

(71) Applicant: BSH HAUSGERAETE GMBH, Munich (DE)

(72) Inventors: Dogan Kilinc, Istanbul (TR); Korhan Orhan, Tekirdag (TR); Tolga Yegin, Istanbul (TR)

(73) Assignee: BSH Hausgeraete GmbH, Munich (DE)

( * ) Notice: Subject to any disclaimer, the term of this patent is extended or adjusted under 35 U.S.C. 154(b) by 43 days.

(21) Appl. No.: 15/363,034

(22) Filed: Nov. 29, 2016

(65) Prior Publication Data

US 2018/0149404 A1 May 31, 2018

(51) Int. Cl.

| | |
|---|---|
| ***F25D 11/02*** | (2006.01) |
| ***F25B 41/06*** | (2006.01) |
| *F25D 29/00* | (2006.01) |

(52) U.S. Cl.

CPC ..... *F25D 11/022* (2013.01); *F25B 41/067* (2013.01); *F25B 2341/0661* (2013.01); *F25B 2600/2511* (2013.01); *F25D 29/00* (2013.01); *F25D 2600/04* (2013.01); *F25D 2700/10* (2013.01); *F25D 2700/12* (2013.01); *F25D 2700/121* (2013.01); *F25D 2700/14* (2013.01)

(58) Field of Classification Search

CPC ..... F25D 11/022; F25D 2700/10; F25D 2700/14; F25D 19/003; F25D 23/003; F25D 23/006; F25D 2600/04; F25D 2700/121

See application file for complete search history.

(56) References Cited

U.S. PATENT DOCUMENTS 2,375,319 A * 5/1945 Muffly ..... F25B 5/02 137/512
2,693,679 A * 11/1954 Staebler ..... F25D 11/022 62/161
3,003,333 A * 10/1961 Lysen ..... F25B 5/02 62/199
3,108,450 A * 10/1963 Crotser ..... F25D 11/022 62/156

(Continued)

*Primary Examiner* — Frantz Jules
*Assistant Examiner* — Nelson Nieves
(74) *Attorney, Agent, or Firm* — Laurence A. Greenberg; Werner H. Stemer; Ralph E. Locher

(57) ABSTRACT

A refrigeration device with a refrigerant circuit for cooling at least two cooling chambers. The device has a condenser of the refrigerant circuit configured to liquidize refrigerant, a compressor of the refrigerant circuit compresses refrigerant, a first evaporator of the refrigerant circuit cools a first cooling chamber of the refrigeration device, a second evaporator of the refrigerant circuit cools a second cooling chamber of the refrigeration device, and a multi suction line of the refrigerant circuit connects the condenser with the compressor. The first and second evaporators are positioned on the multi suction line in a consecutive order. The multi suction line has a first capillary tube, a second capillary tube, and a suction pipe. The first capillary tube connects the condenser with the first evaporator, the second capillary tube connects the condenser with the second evaporator, and the suction pipe connects the first and second evaporator with the compressor.

14 Claims, 4 Drawing Sheets

(56) References Cited

U.S. PATENT DOCUMENTS 3,263,440 A * 8/1966 Hellstrom ..... F25B 39/024 62/288
5,465,591 A * 11/1995 Cur ..... F25B 5/02 62/199
5,765,391 A 6/1998 Lee et al.
9,644,887 B2 * 5/2017 Chung ..... F25D 29/005
9,810,472 B2 * 11/2017 Gomes ..... F25D 11/02
2002/0002838 A1 * 1/2002 Kim ..... F25D 11/022 62/440
2004/0003613 A1 * 1/2004 Shin ..... F25D 11/022 62/199
2004/0050083 A1 * 3/2004 Yuasa ..... F25B 5/00 62/222
2005/0198996 A1 * 9/2005 Itsuki ..... F25B 1/10 62/512
2009/0173086 A1 * 7/2009 Guffler ..... F25B 5/02 62/113
2010/0107661 A1 * 5/2010 Awwad ..... B60H 1/321 62/80
2010/0115973 A1 * 5/2010 Kondou ..... F25B 5/02 62/115
2010/0179693 A1 * 7/2010 Sung ..... F25B 49/025 700/275
2012/0047924 A1 * 3/2012 Li ..... F25B 5/02 62/113
2012/0324918 A1 * 12/2012 Bortoletto ..... F25B 5/00 62/73
2013/0061620 A1 * 3/2013 Li ..... F25B 5/02 62/126
2013/0098081 A1 * 4/2013 Cur ..... F25D 11/006 62/117
2013/0199223 A1 * 8/2013 Brooke ..... F25B 1/02 62/126
2013/0305751 A1 * 11/2013 Gomes ..... F25D 11/02 62/89
2014/0238054 A1 * 8/2014 Gomes ..... F25B 5/02 62/79
2015/0027148 A1 * 1/2015 Chung ..... F25D 11/022 62/89
2016/0265833 A1 * 9/2016 Yoon ..... F25D 11/022
2016/0305696 A1 * 10/2016 Kobayashi ..... F25B 49/02
2016/0363360 A1 * 12/2016 Kim ..... F25B 5/02
2017/0003064 A1 * 1/2017 Lim ..... F25D 11/022
2017/0030615 A1 * 2/2017 Kim ..... F25B 13/00
2017/0122646 A1 * 5/2017 Kuehl ..... F25D 11/022
2017/0241693 A1 * 8/2017 Tajika ..... F25D 11/022
2017/0284724 A1 * 10/2017 Lee ..... F25D 17/065

* cited by examiner

REFRIGERATION DEVICE COMPRISING A REFRIGERANT CIRCUIT WITH A MULTI SUCTION LINE

The present disclosure relates to a multi suction line of a refrigerant circuit of a refrigeration device.

BACKGROUND OF THE INVENTION

Field of the Invention

A refrigeration device can be used to store a variety of goods in cooling chambers at reduced temperature. The refrigeration device includes a refrigerant circuit, which comprises a compressor for compressing refrigerant, a condenser for liquidizing refrigerant, a throttle arrangement with at least one capillary tube to reduce the pressure of the refrigerant, and at least one evaporator for cooling surrounding air.

A refrigeration device can comprise a plurality of cooling chambers to store various goods at different temperatures. To allow for differing temperatures in the cooling chambers, one evaporator is positioned in each of the cooling compartments. Each refrigerator is connected to the condenser by an individual capillary tube to control the specific cooling properties of the respective evaporator. When an increased number of cooling chambers have to be cooled, a significant number of capillary tubes have to be positioned in the refrigeration device, which can result in a cost increase and also in a reduction of available construction space within the refrigeration device.

In U.S. Pat. No. 5,765,391, a refrigeration circulation system is disclosed utilizing two evaporators operating at different evaporating temperatures. The two evaporators are connected to the refrigeration circulation system by separate capillary tubes. However, each evaporator is connected to a single suction pipe.

BRIEF SUMMARY OF THE INVENTION

It is therefore an object of the present disclosure to connect multiple evaporators to a refrigeration circuit in an efficient way.

This object is achieved by way of the features of the independent patent claim. Advantageous developments are the subject matter of the dependent claims, the description and the appended figures.

The present disclosure is based on the finding that the above object can be achieved by a single multi suction line which comprises several tubes, which are combined to a single assembly. The multi suction line comprises several capillary tubes to separately conduct refrigerant to a first and a second evaporator and comprises a suction pipe to conduct refrigerant both from the first and second evaporator to the compressor.

A refrigeration device according to the present invention refers to a domestic, house-hold refrigeration device, which includes any refrigeration device, which is used in the house-hold in homes or in gastronomy. The refrigeration device functions to store food and/or beverages at certain temperatures, and comprises a refrigerator, a freezer, a chest freezer, a fridge-freezer-combination, an ice-box or a wine fridge.

According to an aspect, the present disclosure relates to a refrigeration device having a refrigerant circuit for cooling at least two cooling chambers of the refrigeration device, comprising a condenser of the refrigerant circuit configured to liquidize refrigerant, a compressor of the refrigerant circuit configured to compress refrigerant, a first evaporator of the refrigerant circuit configured to cool a first cooling chamber of the refrigeration device, a second evaporator of the refrigerant circuit configured to cool a second cooling chamber of the refrigeration device, and a multi suction line of the refrigerant circuit configured to connect the condenser with the compressor, wherein the first and second evaporator are positioned on the multi suction line in a consecutive order, wherein the multi suction line comprises a first capillary tube, a second capillary tube, and a suction pipe, wherein the first capillary tube connects the condenser with the first evaporator, wherein the second capillary tube connects the condenser with the second evaporator, and wherein the suction pipe connects the first and second evaporator with the compressor.

As result the first and second capillary tube as well as the suction pipe can be assembled into a single multi suction line. Thereby the complexity of the refrigeration circuit design as well as the construction space required for assembling the refrigeration circuit within the refrigeration device can be reduced.

A separate first capillary tube connects the condenser with the first evaporator, and a separate second capillary tube connects the condenser with the second evaporator. Therefore, by separately controlling the flow of refrigerant in the first and second capillary tube, the cooling power of the first and second evaporator could be individually controlled. After cooling, the refrigerant is conducted to the compressor. To simplify the transfer of refrigerant to the compressor, the first and second evaporators are both connected to the same suction pipe of the multi suction line to allow for an efficient transfer of refrigerant from the first and second evaporator to the compressor through a single line.

According to one example, the first evaporator comprises a first connection element, wherein the first connection element connects the first capillary tube to the suction pipe within the first evaporator to conduct refrigerant from the first capillary tube through the first evaporator and through the first connection element to the suction pipe. As a result, after cooling, the refrigerant can be effectively transferred through the first connection element from the first capillary tube to the suction pipe.

According to one example, the second evaporator comprises a second connection element, wherein the second connection element connects the second capillary tube to the suction pipe within the second evaporator to conduct refrigerant from the second capillary tube through the second evaporator and through the second connection element to the suction pipe. As a result, after cooling, the refrigerant can be effectively transferred through the second connection element from the second capillary tube to the suction pipe.

According to one example, the first and/or second connection element is formed as a T-shaped connection element. As a result, a T-shaped connection element can effectively introduced into the geometry of the first and/or second evaporator, thereby allowing an efficient transfer of refrigerant from the respective evaporator to the suction pipe.

According to one example, the first and second capillary tube comprise differing capillary lengths and/or differing capillary diameters to obtain differing pressure reduction properties of the first and second capillary tube. As a result of the differing capillary lengths and/or differing capillary diameters between the first and second capillary tube, the flow properties of the refrigerant within the first and second capillary tubes are different. Therefore, an efficient control of the cooling properties of the first and second evaporator can be achieved.

According to one example, the refrigeration device comprises a first refrigerant valve configured to close the first capillary tube in a first position and configured to open the first capillary tube in a second position, and wherein the refrigeration device comprises a second refrigerant valve configured to close the second capillary tube in a first position and configured to open the second capillary tube in a second position. As a result by opening or closing the first and second capillary tubes, the flow properties of refrigerant in the first and second capillary tubes can be efficiently controlled and thereby the cooling properties of the first and second evaporator can be efficiently controlled.

According to one example, the refrigeration device comprises a temperature sensor 122*a,b* configured to monitor the temperature of the refrigeration device, wherein the refrigeration device comprises a valve control 123 for controlling the first and second refrigeration valve in respect to the monitored temperature. As a result, the valve control 123 can control the corresponding valves in respect to the monitored temperature, which allows for an efficient control of the cooling properties of the evaporators in respect to the monitored temperature of the refrigeration device.

According to one example, the temperature sensor comprises an exterior sensor 122*a* configured to monitor an exterior temperature of the refrigeration device, and/or wherein the temperature sensor comprises a cooling chamber sensor 122*b* configured to monitor the temperature of the first and/or second cooling chamber, and/or wherein the temperature sensor comprises an evaporator sensor configured to monitor the temperature of the first and/or second evaporator. As a result, the differing temperature sensors enable a comprehensive and precise measurement of various temperatures within the refrigeration device, thereby allowing for an efficient control of the cooling properties of the respective evaporator.

According to one example, the first cooling chamber and second cooling chamber are separated by a cooling floor and are configured to store goods at different temperatures. As a result, by separating the both cooling chamber by a cooling floor, a temperature gradient between both cooling chambers can be maintained. The first and second cooling chambers can e.g. comprise separate geometries, volumes, shapes and/or insulators.

According to one example, the first and second capillary tube are positioned on an exterior surface of the suction pipe, or the first and second capillary tube are positioned within the multi suction line. As a result, by positioning the first and second capillary tube on the exterior surface of the suction pipe, a very effective and cost-efficient fluid connection to the corresponding evaporators can be provided. Alternatively, by positioning the first and second capillary tube within the suction pipe, the capillary tubes can be efficiently embedded within the multi suction line.

According to one example, the refrigeration device comprises a third evaporator of the refrigerant circuit configured to cool a third cooling chamber of the refrigeration device, wherein the first evaporator, the second evaporator and the third evaporator are positioned on the multi suction line in a consecutive order, wherein the multi suction line comprises a third capillary tube, which connects the condenser with the third evaporator, and wherein the suction pipe connects the first, second and third evaporator with the compressor. As a result, to conduct refrigerant to the third evaporator for cooling the third cooling chamber, the diameter of the multi suction line can be simply increased by introducing an additional third capillary tube as well as the length of the multi suction line can be extended to connect the first, second and third evaporator to the suction pipe.

According to one example, the third evaporator comprises a third connection element, wherein the third connection element connects the third capillary tube to the suction pipe within the third evaporator to conduct refrigerant from the third capillary tube through the third evaporator and through the third connection element to the suction pipe. As a result, the third capillary tube can be effectively connected to the suction pipe.

According to one example, the refrigeration device comprises a third refrigerant valve configured to close the third capillary tube in a first position and configured to open the third capillary tube in a second position. As a result, the flow of refrigerant in the third capillary tube can be efficiently regulated.

According to one example, the refrigeration device comprises an additional temperature sensor configured to monitor the temperature of the third cooling chamber of the refrigeration device, wherein the refrigeration device comprises a valve control for controlling the third refrigeration valve in respect to the monitored temperature. As a result, the cooling properties of the third evaporator can be controlled in respect to the monitored temperature.

According to one example, the multi-suction line comprises a first section connecting the condenser with the first evaporator, wherein the first section is S-shaped, traverses the first and second cooling chamber and comprises the first and second capillary tube. As a result, the S-shaped first section of the multi suction line can be efficiently positioned within the refrigeration device, thereby reducing the required construction space.

According to one example, the multi-suction line comprises a second section connecting the first evaporator with the second evaporator, wherein the second section traverses the first and second cooling chamber and comprises the second capillary tube. As result, since the first capillary section ends in the first evaporator, the second section of the multi suction line between the first and second evaporator only comprises the second capillary tube. In case the multi section line comprises a first, second and third capillary tube, the second section of the multi suction line comprises the second and third capillary tube.

Further examples of the principles and techniques of that disclosure are explained in greater detail with reference to the appended drawings, in which:

DETAILED DESCRIPTION OF THE DRAWINGS

Figure 1:
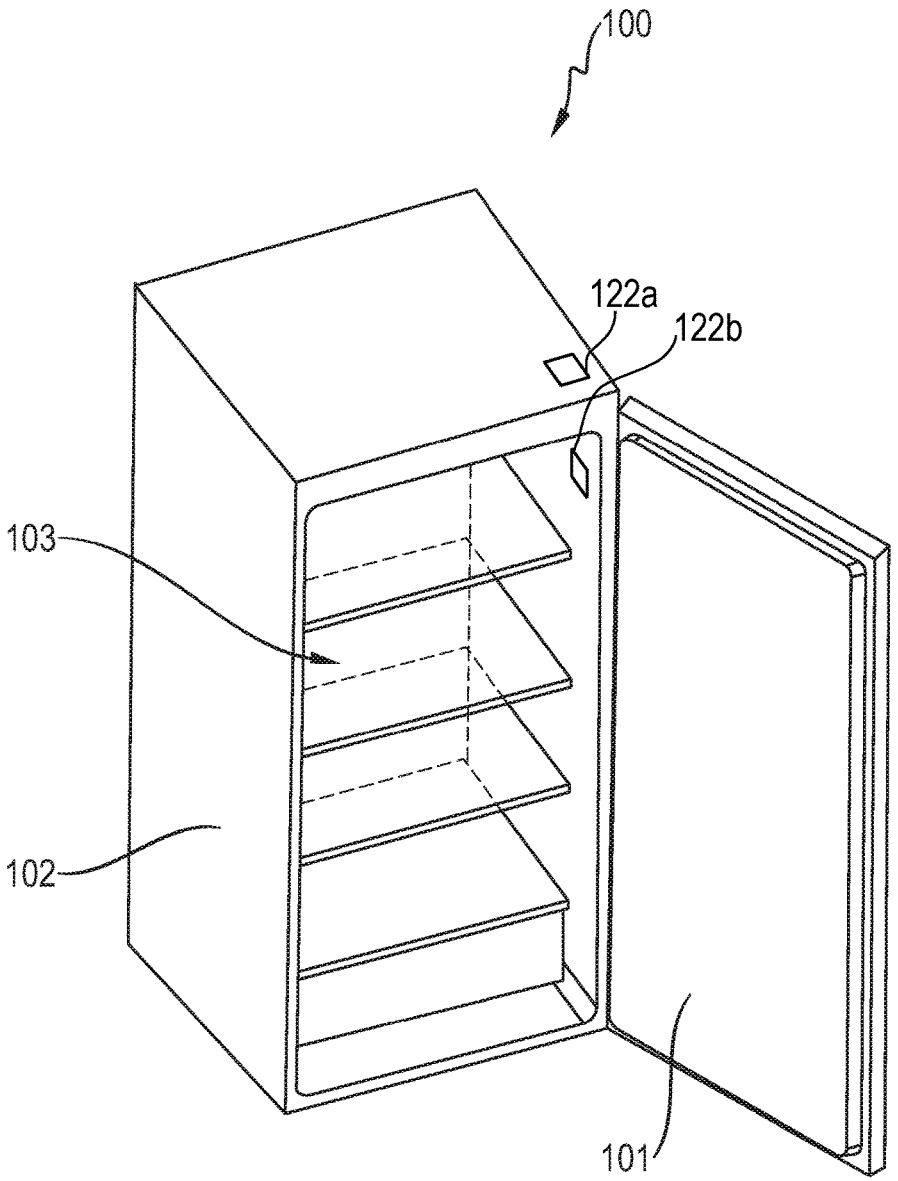
FIG. 1 shows a schematic representation of a refrigeration device.

FIG. 1 shows a schematic representation of a refrigeration device according to the principles described herein. The refrigeration device 100 comprises a refrigerator door 101 and a refrigerator casing 102, wherein the refrigerator door 101 closes a cooling chamber 103 of the refrigeration device 100.

Figure 2:
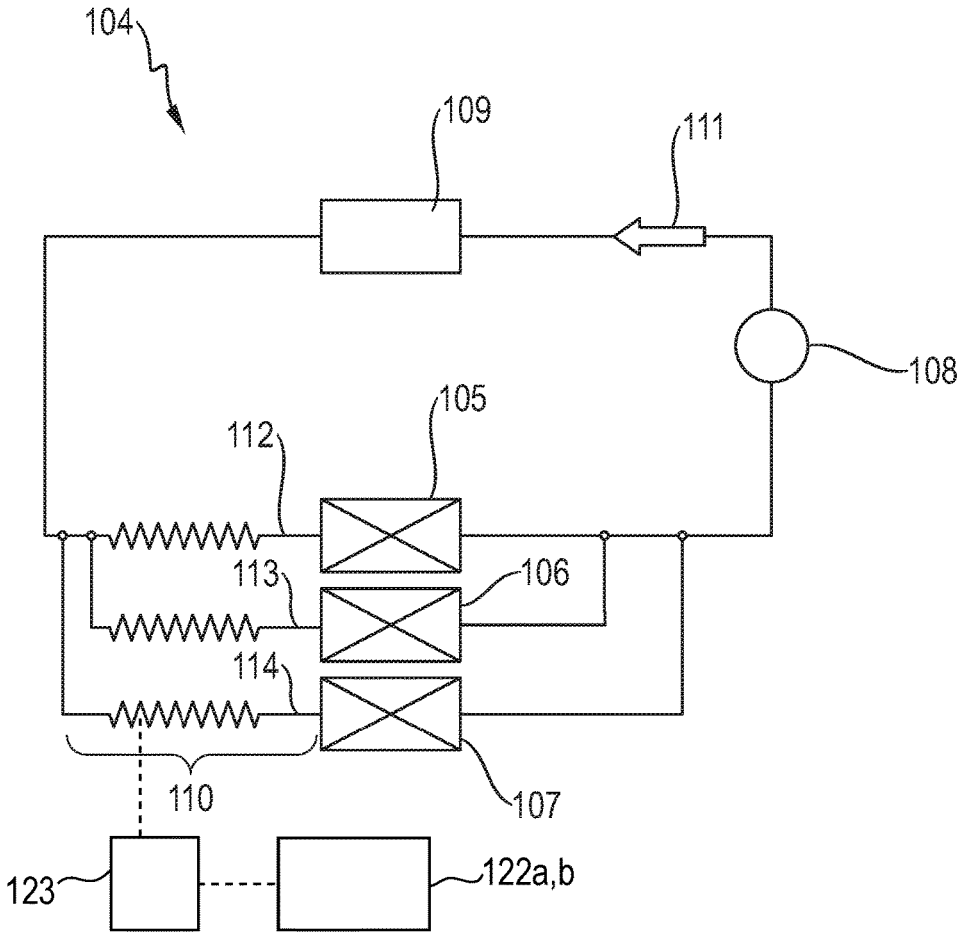
FIG. 2 shows a schematic representation of a refrigerant circuit of a refrigeration device.

FIG. 2 shows a schematic representation of a refrigerant circuit of a refrigeration device.

The refrigeration device 100 comprises one or several refrigerant circuits 104 each comprising at least one evaporator 105, 106, 107, a compressor 108, a condenser 109 and a throttle arrangement 110, wherein refrigerant is conducted through the refrigerant circuit 104 in a flow direction 111. In FIG. 2, the refrigerant circuit 104 comprises a first evaporator 105 for cooling a first cooling chamber of the refrigeration device 100, comprises a second evaporator 106 for cooling a second cooling chamber of the refrigeration device 100, and comprises a third evaporator 107 for cooling a third cooling chamber of the refrigeration device 100.

The throttle arrangement 110 comprises a first capillary tube 112 for connecting the condenser 109 with the first evaporator 105. The throttle arrangement 110 comprises a second capillary tube 113 for connecting the condenser 109 with the second evaporator 106. The throttle arrangement 110 comprises a third capillary tube 114 for connecting the condenser 109 with the first evaporator 105.

The evaporator 105, 106, 107 is a heat exchanger, wherein the liquid refrigerant is vaporized after expanding by heat-uptake from the external medium, e.g. air. The compressor 108 is a mechanically operated device, which pumps refrigerant vapor from the evaporator 105, 106, 107 to the condenser 109 at an increased pressure. The condenser 109 is a heat exchanger wherein after compression the refrigerant vapor is liquidized by transferring heat from the refrigerant to an external medium, e.g. air. The refrigeration device 100 comprises a ventilator to provide an air-flow to the condenser 109 to efficiently cool the condenser 109. The throttle arrangement 110 comprising capillary tubes 112, 113, 114 is a device to reduce the pressure by reducing the diameter within the refrigerant circuit 104. The refrigerant is a fluid, which takes up heat at low temperatures and low pressure and transfers heat at higher temperatures and higher pressure.

Figure 3:
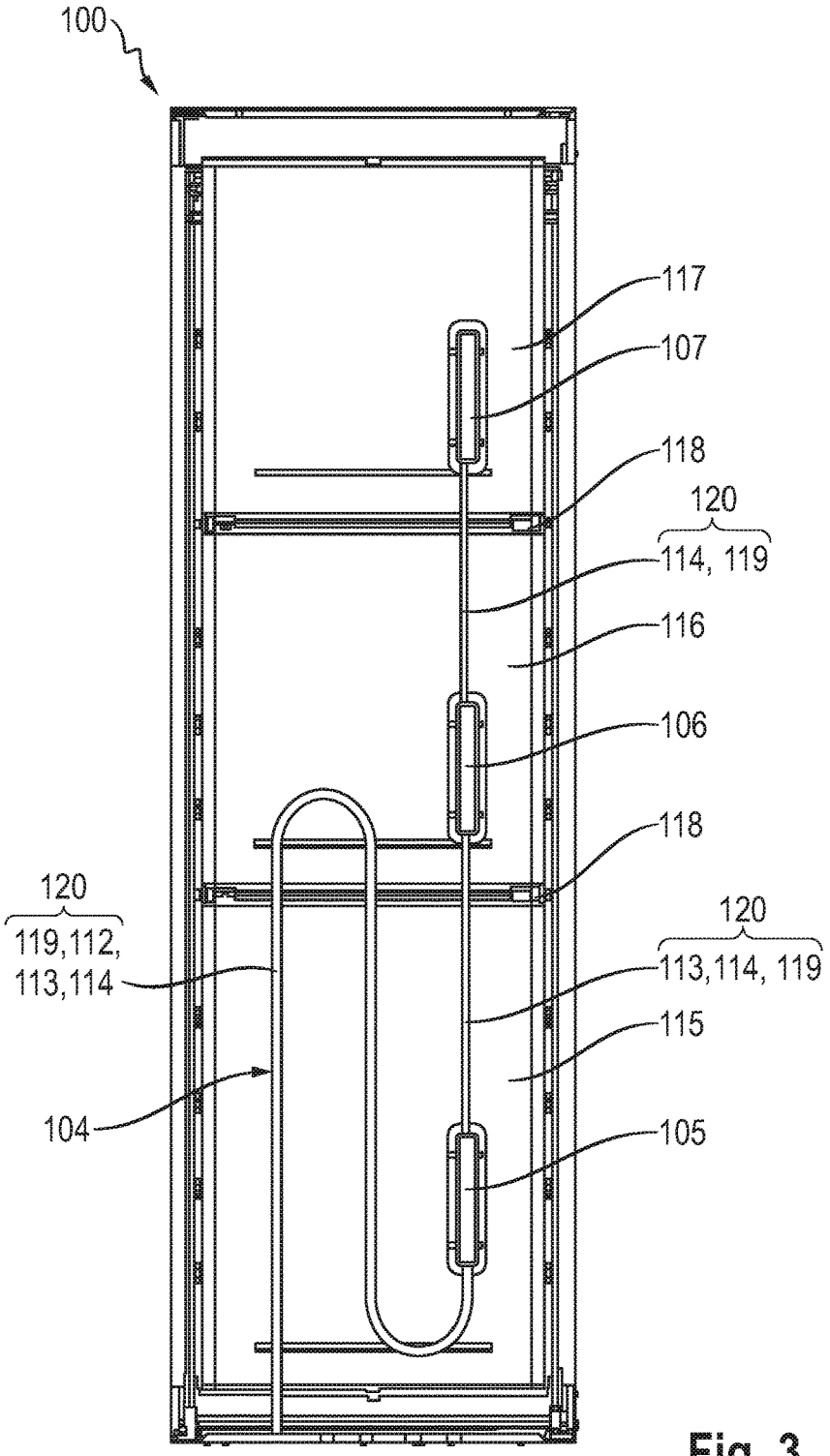
FIG. 3 shows a schematic representation of a refrigeration device comprising a refrigeration circuit having three evaporators.

FIG. 3 shows a schematic representation of a refrigeration device comprising a refrigeration circuit having three evaporators.

The refrigeration device 100 comprises a first cooling chamber 115, a second cooling chamber 116 and a third cooling chamber 117, which are separated from each other by chamber floors 118. The refrigeration device 100 comprises a refrigeration circuit 104, part of which is shown in FIG. 3. The refrigeration circuit 104 comprises a first evaporator 105 for cooling the first cooling chamber 115, a second evaporator 106 for cooling the second cooling chamber 116, and a third evaporator 107 for cooling the third cooling chamber 117 of the refrigeration device 100. Therefore, by controlling the temperature of the evaporators 105, 106, 107, the temperature of the first, second and third cooling chamber 115, 116 and 117 can be controlled.

To conduct refrigerant through the refrigerant circuit 104, the condenser 109 is connected to the first evaporator 105 by a first capillary tube 112, the condenser 109 is connected to the second evaporator 106 by a second capillary tube 113, and the condenser 109 is connected to the third evaporator 107 by a third capillary tube 114. To return the refrigerant to the refrigeration circuit 104, the first, second and third evaporator 105, 106, 107 are connected to a single suction pipe 119, so that the refrigerant from the first, second and third evaporator 105, 106, 107 is conducted to the compressor 108 together.

As depicted in FIG. 3, to allow for an efficient assembly of the refrigeration device 100, the suction pipe 119 is assembled together with the first, second and third capillary tube 112, 113, 114 into a single multi suction line 120, which is positioned in the refrigeration device 100 in a S-like shape and traverses the first and second cooling chamber 115, 116, and also extend to the third cooling chamber 117.

Therefore, a first section of the multi suction line 120 between the condenser 109 and the first evaporator 105 comprises the first, second and third capillary tube 112, 113, 114 together with the suction pipe 119. Since the first capillary tube 112 ends in the first evaporator 105, a second section of the multi suction line 120 between the first evaporator 105 and the second evaporator 106 comprises the second and third capillary tube 113, 114 together with the suction pipe 119. Since the second capillary tube 113 ends in the second evaporator 106, a third section of the multi suction line 120 between the second evaporator 106 and the third evaporator 107 comprises only the third capillary tube 114 together with the suction pipe 119. Therefore, the diameter of the multi suction line 120 decreases from the first evaporator 105, to the second evaporator 106 and to the third evaporator 107.

To control the flow of refrigerant in the first, second and third capillary tubes 112, 113 and 114, respective refrigerant valves are positioned in the corresponding capillary tubes 112, 113 and 114, thereby controlling the cooling efficiency of the first, second and third evaporator 105, 106, 107.

By using the multi suction line 120, there will be no need to use additional adaptors to connect the lines between the evaporators 105, 106, 107 and the compressor 108. Moreover, using a multi suction line 120 decreases the construction space needed for connections between condenser 109 and compressor 108. Furthermore, the multi suction line 120 ensures at least the same cooling performance compared to shorter lines.

Figure 4:
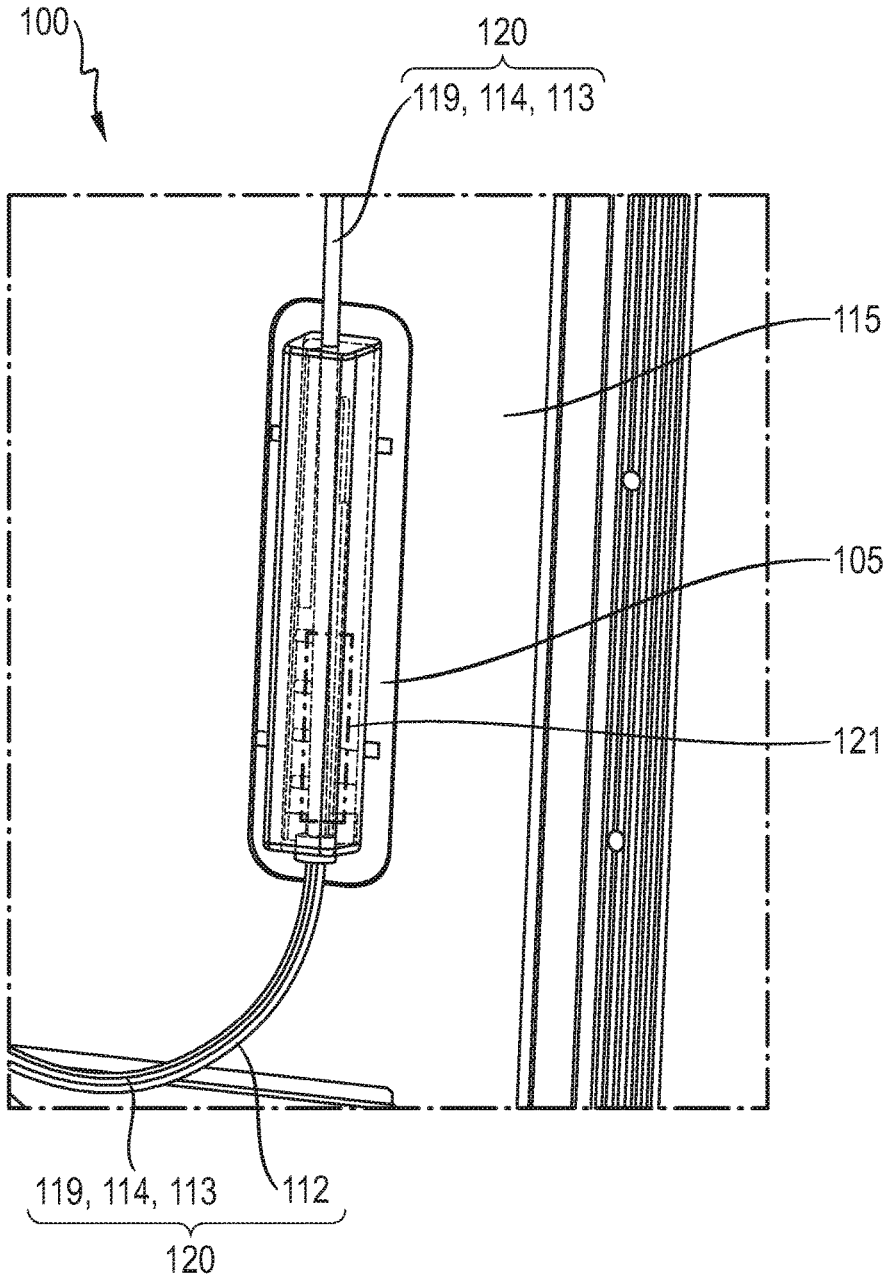
FIG. 4 shows a schematic representation of a first evaporator in a first cooling chamber of a refrigeration device.

FIG. 4 shows a schematic representation of a first evaporator in a first cooling chamber of a refrigeration device according to FIG. 3. A first evaporator 105 of the refrigerant circuit 104 is positioned in a first cooling chamber 115 of the refrigeration device 100 to allow for an efficient temperature reduction in the first cooling chamber 115.

The first evaporator 105 is connected to the refrigerant circuit 104 by a multi suction line 120, which comprises a first, second and third capillary tube 112, 113, 114 and suction pipe 119. In FIG. 4 the first capillary tube 112 is highlighted, which connects the condenser 109 with the first evaporator 105 and ends within the first evaporator 105. The multi suction line 120 further connects the first evaporator 105 with the second evaporator 106, but the multi suction line 120 between the first evaporator 105 and the second evaporator 106 only comprises the second and third capillary tube 113, 114 and the suction pipe 119, since the first capillary tube 112 ends in the first evaporator 105.

To return refrigerant from the first evaporator 105 to the refrigerant circuit 104 and conduct the refrigerant further to the compressor 108, a fluid connection between the first capillary tube 112 inside the first evaporator 105 and the suction pipe 119 is established by a connection element 121, which is formed as a T-shaped connection element 121. After entering the first evaporator 105, the refrigerant is conducted from the first capillary tube 112 through the T-shaped connection element 121 into the suction pipe 119.

While preferred embodiments of the disclosure have been described herein, many variations are possible which remain within the concept and scope of the invention. Such variations would become clear to one of ordinary skill in the art after inspection of the specification and the drawings. The disclosure therefore is not to be restricted except within the spirit and scope of any appended claims.

The following is a summary list of reference numerals and the corresponding structure used in the above description of the invention:

100 Refrigeration device
101 Refrigerator door
102 Refrigerator casing
103 Cooling chamber
104 Refrigerant circuit
105 First evaporator
106 Second evaporator
107 Third evaporator
108 Compressor
109 Condenser
110 Throttle arrangement
111 Flow direction
112 First capillary tube
113 Second capillary tube
114 Third capillary tube
115 First cooling chamber
116 Second cooling chamber
117 Third cooling chamber
118 Chamber floor
119 Suction pipe
120 Multi suction line
121 Connection element

The invention claimed is:

1. A refrigeration device having a refrigerant circuit for cooling at least two cooling chambers of the refrigeration device, comprising:

a condenser of the refrigerant circuit configured to liquidize refrigerant;

a compressor of the refrigerant circuit configured to compress the refrigerant;

a first evaporator of the refrigerant circuit configured to cool a first cooling chamber of the refrigeration device;

a second evaporator of the refrigerant circuit configured to cool a second cooling chamber of the refrigeration device;

a third evaporator of the refrigerant circuit configured to cool a third cooling chamber of the refrigeration device; and a multi suction line of the refrigerant circuit configured to connect the condenser with the compressor, wherein the first evaporator, the second evaporator and the third evaporator are positioned on the multi suction line in a consecutive order, wherein the multi suction line comprises a first capillary tube, a second capillary tube, a third capillary tube, and a suction pipe, wherein the first capillary tube directly connects the condenser with the first evaporator, wherein the second capillary tube directly connects the condenser with the second evaporator;

wherein the third capillary tube directly connects the condenser with the third evaporator; and wherein the suction pipe connects the first, second and third evaporator with the compressor; and wherein multi suction line is a single multi suction line;

wherein the suction pipe is assembled together with the first, second and third capillary tube into the single multi suction line, wherein a first section of the multi suction line between the condenser and the first evaporator comprises the first, second and third capillary tube together with the suction pipe, wherein a second section of the multi suction line between the first evaporator and the second evaporator comprises the second and third capillary tube together with the suction pipe, wherein a third section of the multi suction line between the second evaporator and the third evaporator comprises only the third capillary tube together with the suction pipe, and the diameter of the multi suction line decreases from the first evaporator, to the second evaporator and to the third evaporator.

2. The refrigeration device according to claim 1, wherein the first evaporator comprises a first connector, wherein the first connector connects the first capillary tube to the suction pipe within the first evaporator to conduct the refrigerant from the first capillary tube through the first evaporator and through the first connector to the suction pipe.

3. The refrigeration device according to claim 1, wherein the second evaporator comprises a second connector, wherein the second connector connects the second capillary tube to the suction pipe within the second evaporator to conduct the refrigerant from the second capillary tube through the second evaporator and through the second connector to the suction pipe.

4. The refrigeration device according to claim 3, wherein the first or second connector is formed as a T-shaped connection element.

5. The refrigeration device according to claim 1, wherein the first and second capillary tube comprise differing capillary lengths or differing capillary diameters to obtain differing pressure reduction properties of the first and second capillary tube.

6. The refrigeration device according to claim 1, wherein the refrigeration device comprises a first refrigerant valve configured to close the first capillary tube in a first position and configured to open the first capillary tube in a second position, and wherein the refrigeration device comprises a second refrigerant valve configured to close the second capillary tube in a first position and configured to open the second capillary tube in a second position.

7. The refrigeration device according to claim 6, wherein the refrigeration device comprises a temperature sensor configured to monitor a temperature of the refrigeration device, wherein the refrigeration device comprises a valve controller for controlling the first and second refrigeration valve in respect to the monitored temperature.

8. The refrigeration device according to claim 7, wherein the temperature sensor comprises an exterior sensor configured to monitor an exterior temperature of the refrigeration device, or wherein the temperature sensor comprises a cooling chamber sensor configured to monitor a temperature of the first or second cooling chamber, or wherein the temperature sensor comprises an evaporator sensor configured to monitor a temperature of the first or second evaporator.

9. The refrigeration device according to claim 1, wherein the first cooling chamber and second cooling chamber are separated by a separator wall and are configured to store goods at different temperatures.

10. The refrigeration device according to claim 1, wherein the first and second capillary tube are positioned on an exterior surface of the suction pipe, or wherein the first and second capillary tube are positioned within the suction pipe.

11. The refrigeration device according to claim 1, wherein the third evaporator comprises a third connector, wherein the third connector connects the third capillary tube to the suction pipe within the third evaporator to conduct the refrigerant from the third capillary tube through the third evaporator and through the third connector to the suction pipe.

12. The refrigeration device according to claim 1, wherein the refrigeration device comprises a third refrigerant valve configured to close the third capillary tube in a first position and configured to open the third capillary tube in a second position.

13. The refrigeration device according to claim 1, wherein the multi-suction line comprises a first section connecting the condenser with the first evaporator, wherein the first section is S-shaped, traverses the first and second cooling chamber and comprises the first and second capillary tubes.

14. The refrigeration device according to claim 1, wherein the multi-suction line comprises a second section connecting the first evaporator with the second evaporator, wherein the second section traverses the first and second cooling chamber and comprises the second capillary tube.

* * * * *